United States Patent [19]

Wuchterl

[11] Patent Number: 4,938,374

[45] Date of Patent: Jul. 3, 1990

[54] BEVERAGE CONTAINERS AND METHOD OF MAKING SAME

[76] Inventor: Joseph E. Wuchterl, 637 Pickwick Ct., Mt. Prospect, Ill. 60056

[21] Appl. No.: 256,726

[22] Filed: Oct. 12, 1988

[51] Int. Cl.[5] ..... B65D 1/24

[52] U.S. Cl. ..... 220/83; 220/1 BC; 220/23.83

[58] Field of Search ..... 220/23.2, 83, 1 BC, 220/DIG. 13, 23.4, 23.83; 206/431; D9/413, 407, 401, 374, 368

[56] References Cited

U.S. PATENT DOCUMENTS

| | | | |
|---|---|---|---|
| D. 254,714 | 4/1980 | Mascia | D9/368 |
| D. 273,768 | 5/1984 | Sedam | D9/375 |
| 750,077 | 1/1904 | Bandlow | 220/274 |
| 3,369,654 | 2/1968 | Hasselmann | 220/23.4 X |
| 3,420,367 | 1/1969 | Carmichael | 220/1 BC |
| 4,782,945 | 11/1988 | Geiler et al. | 220/23.83 X |

*Primary Examiner*—Steven M. Pollard

*Attorney, Agent, or Firm*—Bernard L. Kleinke; William Patrick Waters; Jerry R. Potts

[57] ABSTRACT

A carbonated beverage container and method of making it, includes a side and bottom wall body, which is generally rectangular in shape throughout its axial length. A smoothly tapered neck portion has a generally round top end and a generally rectangular bottom end, joined to the body. A generally round top wall having a closure device, is sealed to the top end of the tapered neck.

9 Claims, 2 Drawing Sheets

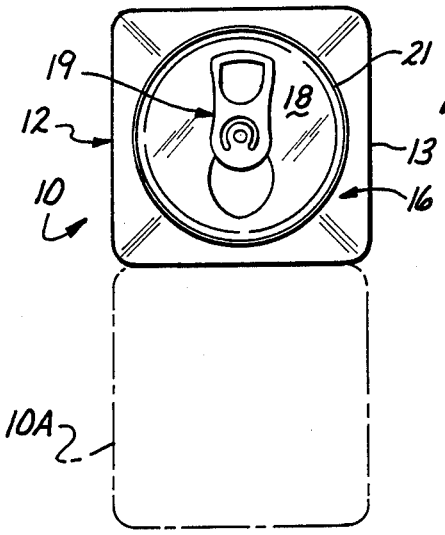
FIG. 1
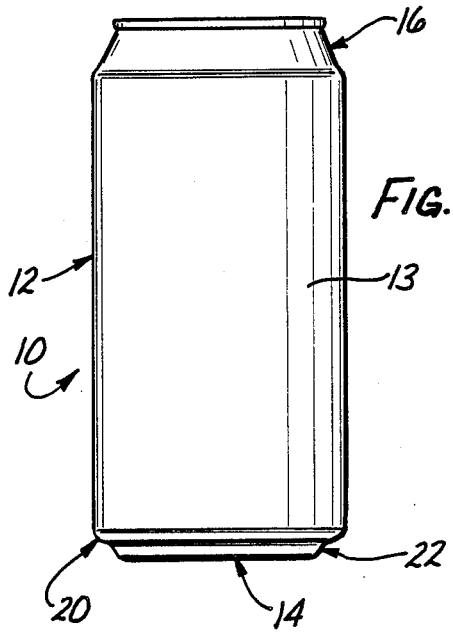
FIG. 2
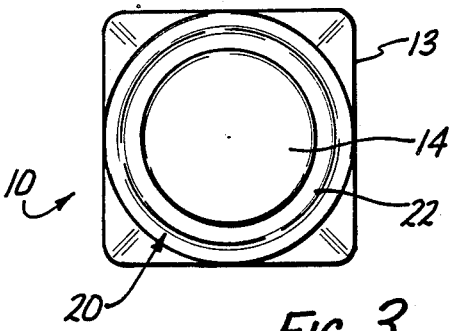
FIG. 3
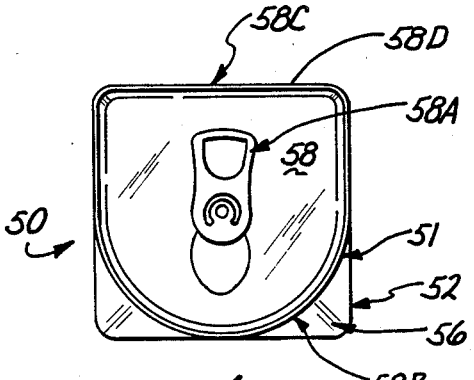
FIG. 4
FIG. 7
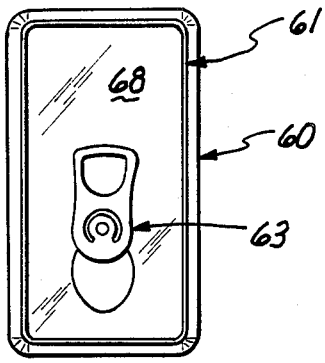

BEVERAGE CONTAINERS AND METHOD OF MAKING SAME

DESCRIPTION

1. Technical Field

The present invention relates in general with beverage containers, and the method of making them. More particularly, the present invention relates to carbonated beverage containers, and an improved method of making them.

2. Background Art

For years, carbonated beverages such as soda pop and beer have been marketed in cylindrical cans having a round bottom and a round top wall. This container configuration has remained essentially unchanged for many years with the exception of the introduction of the pull tab closure in the top wall, which pull tab closure enables the consumer access to the contents of the container without the necessity of utilizing a can opener.

Because of their popularity, millions of cans of soda pop and beer are sold each year. In addition, the general public is familiar with large numbers of competitors who produce a great variety of beers and other beverages. This results in the necessity for vendors to allocate very large areas for the storage and display of the great variety of canned beverages which exist. For example, it is not unusual for one side of an entire aisle of a market or store to be devoted to the display of beer and beverage containers. Because of the premium on market shelf space, there are significant economic considerations relating to the storage and display of carbonated beverages.

In order to facilitate storage, display and sale of beverage containers, manufacturers frequently package the containers in clusters. The cluster of beer or soft drinks known as the "six-pack" is well known. Typically, the containers are constrained within a cardboard container or a plastic carrier, which permit ease of handling of the containers by the vendors and by the purchasers of the product.

There are a number of reasons for the popularity of the round container. Among them is the fact that the container is easily grasped by the consumer. In addition, the round shape permits the consumer to drink easily from the container itself or, in the alternative, to pour the contents from the container into a cup or glass.

A disadvantage of the round container is that, in most cases, its contents are cold so that the container itself is frequently slippery and wet from condensation accumulations on the outer surface of the container. In this regard, round containers, in use, under circumstances where the container is wet, for the container to become slippery and difficult for the consumer to hold, and thus, may readily slip from the grasp of the consumer inadvertently.

Apart from consumer considerations, the round cross-sectional configuration of beverage containers has been considered desirable to help facilitate the manufacturing process. In its manufacture, the round shape of the conventional can has been utilized to help transport them from one station to the next, during the manufacturing process. In this regard, they have been rolled downwardly, under the force of gravity, along various guides so as to be moved from one position to another during the manufacturing process.

While the round configuration can be an advantage in the manufacturing process, it also can present certain difficulties. Among these are the fact that the round configuration tends to require more control of the containers to prevent them from rolling off work surfaces or rolling inadvertently toward undesirable locations. Therefore, while the circular cylindrical container has been found to be acceptable for some applications, it would be highly desirable to have a beverage container, as well as a method of making it, in such a manner as to avoid the inconvenience and the manufacturing difficulties engendered by the conventional container.

Another important reason for the utilization over the years of the familiar round beverage container, is related to the nature of the seal between the top wall and the body of the container. Especially for carbonated beverages confined under pressure, it is important to seal the top wall and the one-piece body together securely in a leak tight and pressure tight manner. For years, a round container body joined to a round top wall by an annular seal provided the appropriate pressure tight and leak tight requirements for pressurized beverage containers. However, because of the foregoing difficulties presented by the round container, it would be highly desirable to have a pressurized beverage container which is different in design from the well known conventional container and yet overcomes all of the prior mentioned shortcomings, while having an equally effective seal to make it leak tight and pressure tight. In this regard, such a new and improved pressureizable container, must not only overcome all of the foregoing disadvantages, but it must also be readily and conveniently sealable.

Another critical consideration in the use of the conventional beverage cans is an economic one. Prior to its use by the consumer, the beverage container is subjected to a substantial number of manufacturing and handling operations. These operations begin with the container manufacturing process itself, which, in turn, is followed by the filling and sealing process at the brewery or soft drink bottling plant. Typically, after the container has been filled and sealed, it is transported to distributors and retail outlets, or other chains of distribution, until the containers are made accessible to the consumer.

At each step of the process of making the filled carbonated beverage containers available to the public, the containers must be stored, and, where storage is required, the round shape of the carbonated beverage container presents major economic considerations. Storage is a problem with normal containers, because they do not nest or otherwise stack in a closely spaced and compact manner. These considerations adversely affect economically the manufacturer who must allocate costly storage space for inventory. It also impacts adversely the carrier who transports the containers. In this regard, storage space in both warehouse and vehicle is a major economic consideration.

Even at the penultimate step of its journey, just before the container passes to the consumer, the conventional configuration of the container presents major economic considerations. In the case of stores and supermarkets, these considerations are readily apparent. The round beverage containers are often clustered in two rows of three within a cardboard container, or plastic carrier, and the aggregate referred to as a six pack. Six packs, in turn, are commonly grouped within a larger container, thereby forming a case comprising twenty-four like containers filled with carbonated beverage. In the store or supermarket, shelf space is at a premium, and a high level of competition exists for each square inch of such space. It would be highly desirable to have a beverage container having the leak tight characteristics of the round can, and capable of holding the same volume of carbonated liquid as the conventional container or can, with a significant saving in shelf space.

Space considerations of course, are not limited to shelves in stores and markets. Wherever beverage containers are sold to the public, storage considerations are very important and have a significant economic impact. The storage of cans, whether in the filled condition or while empty at the manufacturing or bottling plant, is necessary at each step of the process from manufacturer to ultimate consumer. Thus, storage space and the optimization of its use, are very important business and economic considerations for the manufacturer, the transporter, and the retailer. An improved carbonated beverage container construction, which is more economical to store, transport and display, as well as one which is practical to manufacture and to use, would be highly desirable.

In addition, carbonated beverage containers are marketed not only through stores or the like, but also to other businesses. For example, it is clear that restaurants and bars have to consider storage of their inventories of canned beverages. In yet another application, the carts utilized by flight attendants on airplanes during sale of carbonated beverages to customers are, in large measure, bulky and hard to store and to manage, because of the necessity to store in aircraft and to distribute to passengers, in flight, in significant quantities, causes problems for storage, distribution and customer usage.

A further aspect of the beverage container market where space is a critical consideration, is seen in vending machines. These machines are commonly utilized in constricted spaces, and it would be economically advantageous, if the frequency of servicing and replenishing the machines could be reduced. This practical improvement could be attained, if a larger number of like carbonated beverage containers could be stored more compactly within the vending machines, as compared to known containers.

Further, a carbonated beverage container, before it is ultimately consumed, is stored at home in a refrigerator to chill the contents of the container. With the reduction in the size of modern homes and apartments, a corresponding reduction in the size of appliances has occurred. Therefore, available space in refrigerators has become a very important consideration for the consumer.

In light of the above, it would be very desirable to have pressurized beverage containers easily packaged with like units in a more closely spaced and compact configuration as compared to prior known containers, so as to permit storage of greater volumes of liquid than otherwise possible with heretofore known containers. Of course, at the same time, such a new compact container for carbonated beverages would have to possess all of the previously indicated advantages and features.

Varieties of containers, and holding devices for them, have been known in the art. For example, reference may be made to U.S. Pat. Nos. 1,337,195; 1,743,283; 3,172,386; 3,420,376; and 3,458,035.

However, the containers disclosed in the foregoing patents are not containers for carbonated beverages. In this regard, none of the patented containers are pressureizable, and thus, are not at all suitable for carbonated beverages. Certainly, none of the patented containers is constructed in such a manner that it can be efficiently and effectively manufactured according to modern, high speed mass production techniques for filling and sealing liquid carbonated beverages under pressure. Additionally, none of the patented containers would overcome all of the foregoing problems, in a practical, cost effective manner. In this regard, a carbonated beverage container that can be manufactured at a similar cost as conventional containers, stored compactly, and used by the consumer conveniently.

DISCLOSURE OF INVENTION

It is the principal object of this invention to provide a new and improved carbonated, pressurized, beverage container, and a method of making it, such that the container is more convenient for the consumer to use, is able to be manufactured by modern filling and sealing processes, and is capable of storing the same or similar volume of carbonated liquid as known containers, but in a substantially smaller volume than that required for such known containers.

It is a further object of the present invention to provide such a new and improved carbonated, pressurized, beverage container, and a method of making it, such that the container is convenient to hold in the hand and drink from, when opened.

A carbonated beverage container and method of making it, includes a side and bottom wall body, which is generally rectangular in shape throughout its axial length. A smoothly tapered neck portion has a generally round top end and a generally rectangular bottom end, joined to the body. A generally round top wall having a closure device, is sealed to the top end of the tapered neck.

By the inventive construction and manufacturing techniques, a carbonated beverage container can be closely stacked with like units, in a substantially smaller space, even as much as almost a twenty-five percent reduction in volume, as compared to known containers. Also, the novel neck portion and top wall lend themselves to modern fitting and sealing techniques.

Moreover, the inventive containers can be grasped more securely, even when cold and wet. Also, the new containers, when opened, can be readily and conveniently used to drink the contents therefrom.

The novel construction also greatly reduces the unwanted rolling of the containers inadvertently during certain manufacturing processes, and during subsequent handling by distribution of the product and during subsequent use by the consumer.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein:

FIG. 1 is a top plan view of a carbonated beverage container which is constructed according to the present invention, and which indicates in phantom lines how like containers can be stored closely together;

FIG. 2 is a side elevational view of the container of FIG. 1:

FIG. 3 is a bottom view of the container of FIG. 1:

FIG. 4 is a top plan view of another carbonated beverage container, which is also constructed according to the present invention;

FIG. 7 is a top plan view of the container of FIG. 7;

BEST MODE FOR CARRYING OUT THE INVENTION

Figure 5:
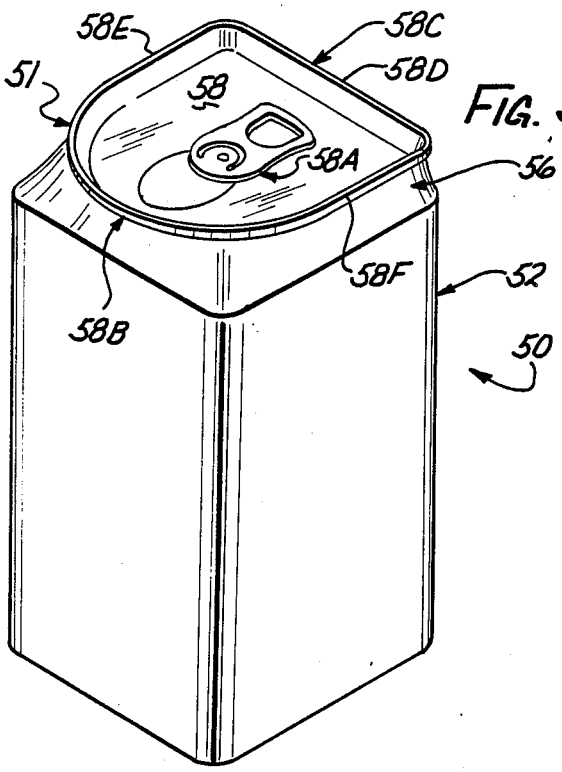
FIG. 5 is a pictorial view of the container of FIG. 4.

Referring now to the drawings, there is depicted, in FIGS. 1, 2 and 3, a carbonated beverage container 10, which is constructed according to the present invention. The container 10 is adapted for containing carbonated beverages under pressure, such as beer or carbonated soft drinks.

The container 10 generally comprises a hollow side and bottom wall 12, which has an integral bottom portion 14 and which terminates at its upper end in an integral tapered neck portion 16. A generally circular top wall 18 covers over, and is sealed to, the top portion of the tapered neck portion 16 at annular seal 21.

With reference to FIG. 1, a conventional pull tab device 19, is connected sealingly over a pour opening (not shown) in the top wall 18, and is adapted to be removed manually in a conventional manner. In this manner, the pressurized liquid can be confining the beverage in the container 10, and yet can be poured therefrom for consumption of the contents. An annular chine seal 21 forms the top edge of the neck portion 16 and serves to attach sealingly the top wall 18 of the body 12 in a continuous, uninterrupted, leak tight manner. According to a feature of the invention, when the closure device 19 is removed, the circular wall 18 and the mating circular top edge of the novel tapered neck 16, spaced closely from the device 19, provides a smoothly contoured drinking surface.

Due to such smoothly rounded and contoured mating surfaces between the top wall 18 and the top edge of the tapered neck 16, the container 10 can be readily and effectively filled and sealed according to modern high speed manufacturing techniques. Thus, a continuous, uninterrupted seal can be achieved at the seal 21.

In FIG. 1, the body 12 is substantially square in cross section throughout its axial length. In this regard, the neck portion is configured to have a generally square bottom edge and a generally circular top edge at the generally circular annular seal 21.

FIG. 1 depicts in phantom lines a beverage container 10A, which is similar to the container 10, and which is adapted to abut a side of container 10 in a closely spaced configuration. In use, beverage containers constructed according to the present invention can be stored or packaged in close contact with similar or like units as indicated in FIG. 1. Because of the large mating contact surfaces of the body 12 and the corresponding bodies of other, similar containers, the areas of contact between containers is significantly increased over that possible when round containers are placed in contact one with another. As compared with prior known carbonated beverage containers, the reduction in lost, interstitial space affected by the present invention results in a capability of containing a given volume of carbonated beverage in approximately twenty-five percent less space than that required for the containment of a similar volume in such conventional containers.

It will be clear to one skilled in the art of beverage containers that containers constructed according to the present invention can be clustered together to form six packs or eight packs or other convenient groupings with substantial space saved over similar groupings of round containers. Thus, for example, six-packs of the inventive containers can be arranged in a single row, or in two rows of three.

Considering now the body 12 in greater detail, with respect to FIGS. 2 and 3, the bottom 14 is integrally connected at the bottom portion of the body 12. Body 12, being square in cross-section, is rounded at the bottom portion of the side wall 13 at 20, and extends to a tapered pedestal portion 22 which, in turn, is reversely bent and terminates in the generally circular, recessed bottom wall 14.

At the top portion of the container 10, as illustrated in FIG. 2, the body 12 is connected integrally to the round annular seal 21 by the tapered neck portion 16. Tapered neck portion 16 is generally truncated and conical in shape, so as to join smoothly, at its bottom edge, with the body 12, and, at its top edge, with the circular annular seal 21, so as to provide a smooth transition from the square shaped body to the round top wall 18.

Referring now to FIGS. 4 and 5, there is shown another carbonated beverage container 50, which is also constructed in accordance with the present invention. Container 50 is similar to container 10 of FIG. 1 in that it includes a generally square hollow bottom and side wall body 52 similar to body 12 of FIG. 1, except that its top portion includes a somewhat different configuration.

With reference now to FIG. 4, a top wall 58 having a pull tab closure device 58A is connected integrally to the top edge of the body 52. The top wall 58 differs from the top wall 18 of the container 10, in that rather than being circular in configuration, top wall 58 is generally circular in configuration, with a semicircular front edge 58B joining a U-shaped rear edge 58C. The U-shaped edge 58C includes a rear edge 58D and parallel, spaced apart side edges 58E and 58F. The semi-circular edge 58B serves as a convenient drinking and pouring edge. In order to join top wall 58 to body 52, an annular seal 51 conforms to the shape of top wall 58. As a result, the tapered neck portion 56 affords a smooth transition from the square shaped configuration of the top edge of the body 52 to the shape of seal 51.

It will be readily apparent to one skilled in the art that the ease of handling, of access to the contents of the container and the storage space saving characteristics of the container 10, are present also in the container 50 of the present invention.

Figure 6:
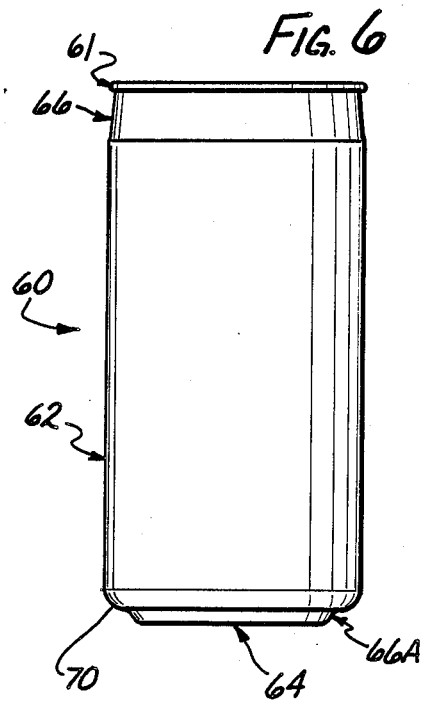
FIG. 6 is a side elevational view of yet another carbonated beverage container, which is also constructed according to the present invention.

Referring now to FIGS. 6 and 7, there is depicted another carbonated beverage container 60, constructed in accordance with the present invention.

Container 60 generally comprises a top wall 68, having a conventional pull tab device 63, connected at an annular seal 61 to a side and bottom wall body 62 to close it sealing in a similar manner as the container 10, thereby confining the beverage in container 60 under pressure. In this form of the invention, body 62 is generally rectangular in cross section throughout its axial length. A tapered neck portion 66 provides a smooth transition from the top edge of the body 60 at the seal 61, where the generally rectangular top wall 68 and the tapered neck 66 are connected in a continuous leak tight seal. The body 62 is integrally connected to the bottom wall 64 which has a cross sectional area less than that of body 62, in a similar manner as the body 12 of the container 10. Transition from the larger cross sectional area of body 62 to bottom wall 64 is accomplished by means of curved annular corner portion 70, whereby body 62 smoothly joins tapered pedestal 66*a* which in turn smoothly joins bottom wall 64.

Figure 9:
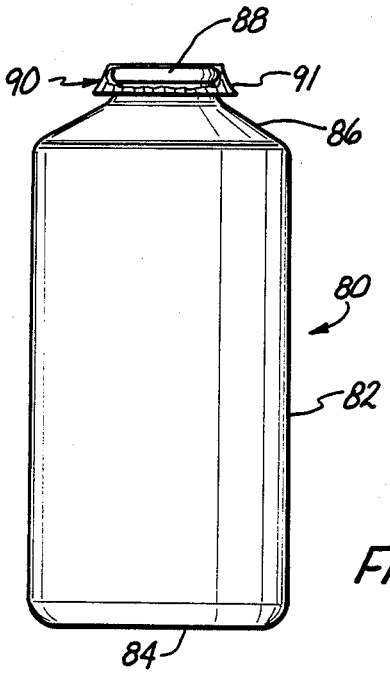
FIG. 9 is a side elevational view of the container of FIG. 8.
Figure 8:
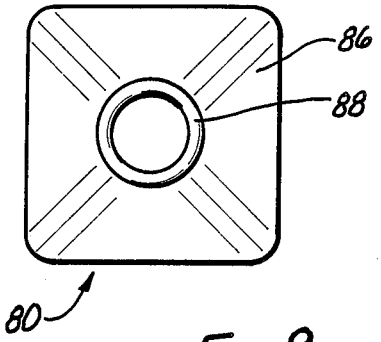
FIG. 8 is a top plan view of a further carbonated beverage container, which is also constructed according to the present invention.

Referring now to FIGS. 8 and 9, there is depicted still another carbonated beverage container 80 constructed in accordance with the present invention. In this form of the invention, the container 80 includes a side and bottom wall body 82 which is generally square in cross section throughout its axial length, and which is composed of glass material. The body 82 includes an integrally formed bottom wall 84 and a smoothly tapered neck portion 86 terminating at the top of the container 80 in a circular annular bead 88. A metal cap 90, shown in FIG. 9, has a depending skirt or flange 91, which engages and fits over sealingly the bead 88 so a to securely seal the beverages under pressure within the container. It should be noted that cap 90 is shown broken away for illustration purposes in FIG. 9, and is omitted from FIG. 8.

The tapered neck portion 86 has a large generally square bottom edge joined continuously in a smoothly contoured manner with the top edge of the body 82. The small top edge of the tapered neck portion 86 is generally circular in configuration and terminates in the bead 88 for receiving the cap 90.

While particular embodiments of the present invention have been disclosed, it is to be understood that various different modifications are possible and are contemplated within the true spirit and scope of the appended claims. For example, all of the inventive containers are preferably composed of metal or glass material. The metal material is preferably either aluminum or steel. However, other types of materials may also be employed, such as suitable metal alloys, as will become apparent to those skilled in the art. There is no intention, therefore, of limitations to the exact abstract or disclosure herein presented.

What is claimed is:

1. A carbonated beverage container comprising:

a hollow side and bottom elongated wall body being rectangular in cross section throughout its axial length and having a centrally disposed axis;

a smoothly tapered hollow neck portion being generally circular and symmetrical in cross section throughout its axial length, said hollow neck portion having a generally circular top end portion and a large rectangular bottom end portion being connected integrally to the top end portion of said body;

said top end portion being smoothly rounded and contoured for facilitating the filling of the container therethrough during an initial container filling operation;

said neck portion having a centrally disposed axis aligned with the body central axis, said neck portion being symmetrical in configuration relative to the central axis;

a generally circular and substantially flat top wall sealed to said tapered neck portion at its generally ciruclar top end portion;

pour opening pull tab device disposed closely to the neck top end for serving as a smoothly contoured drinking surface to facilitate the pouring of the container contents therefrom; and annular chine means for sealing together the entire edge of said generally circular top wall and the neck top end portion in a continuous, uninterrupted, leak tight manner to maintain the contents of the container under high pressure.

2. A carbonated beverage container according to claim 1, wherein said body is square in cross section.

3. A carbonated beverage container according to claim 1, wherein said body and neck portions and top wall are each composed of materials selected from the class consisting of metal and glass.

4. A carbonated beverage container according to claim 3, wherein said metal is selected from the class consisting of aluminum and steel.

5. A carbonated beverage container according to claim 1, wherein said closure means is a pull tab closure.

6. A carbonated beverage container according to claim 1, wherein said closure means is a cap.

7. A carbonated beverage container according to claim 1, wherein said top wall includes a rectilinear portion, and said small end portion of said tapered neck portion includes a complimentarily shaped rectilinear portion.

8. A carbonated beverage container according to claim 1, wherein said body is square in cross section, and said top wall is circular, said container being composed entirely of metal material.

9. A carbonated beverage container according to claim 1, wherein said top wall includes a semicircular front edge for weaving as a drinking and pouring edge, said front edge joining a substantially U-shaped rear edge.

* * * * *